United States Patent [19]

Liu

[11] 4,373,371

[45] Feb. 15, 1983

[54] METHOD OF REDUCING SPRINGBACK IN MECHANICALLY PRESSED SHEET MATERIALS-I

[75] Inventor: You C. Liu, Bloomfield Hills, Mich.

[73] Assignee: Ford Motor Company, Dearborn, Mich.

[21] Appl. No.: 220,348

[22] Filed: Dec. 29, 1980

[51] Int. Cl.[3] ..... B21D 5/01

[52] U.S. Cl. ..... 72/379; 72/382; 72/465

[58] Field of Search ..... 72/348, 350, 356, 379, 72/382, 384, 701, 702

[56] References Cited

U.S. PATENT DOCUMENTS

| | | | |
|---|---|---|---|
| 1,442,912 | 1/1923 | Stoddard | 72/348 |
| 2,389,974 | 11/1945 | Greig | 72/382 |
| 2,943,587 | 7/1960 | Samuelsson | 72/701 |
| 2,966,873 | 1/1961 | Hoffman et al. | 72/465 |
| 3,705,512 | 12/1972 | Koschatzky | 72/57 |
| 3,844,156 | 10/1974 | Hanni et al. | 72/389 |

*Primary Examiner*—Lowell A. Larson

*Attorney, Agent, or Firm*—Joseph W. Malleck; Olin B. Johnson

[57] ABSTRACT

A method of pressing sheet material utilizing counterpad pressure to eliminate springback is disclosed. The sheet material is sequentially bent at pairs of bend radii during first and second increments of striking. The first increment of striking is carried out with little or no counterpad pressure to permit a curvilinear section to form immediately beneath the male punch member due to the bending moment. The second increment of striking is carried out with a positive counterpad pressure effective to flatten the curvilinear section and thereby space the second pair of bend radii from the first pair. Residual springback from the first bending action subtracts from the springback of the second bending to reduce the resultant springback in the product.

13 Claims, 13 Drawing Figures

METHOD OF REDUCING SPRINGBACK IN MECHANICALLY PRESSED SHEET MATERIALS-I

BACKGROUND OF THE INVENTION

Springback is a phenomenon always present in the bending of metal. Bending operations for sheet metal are typically carried out by the use of presses broadly classified by the source of power as hydraulic or mechanical. Certain alternatives are available when using hydraulic presses to control springback, within tolerable limits, because of the lower strain rate involved. However, more efficient and rapid production can be achieved with mechanical presses which use much higher strain rates resulting from high speed ram movement.

The final shape of sheet metal parts formed by mechanical press bending depends importantly upon the control of springback. Springback is the natural tendency of the material to revert to its original shape after the bending force has been removed. It has been generally believed heretofore that the springback is proportional to a certain group of parameters which include the bending radius, the thickness of the product material, and the hardness of the material. It has been conventional for tool designers to correct such springback by (a) over-compensating through an overbend whereby the product will relax to a shape that is precisely desired upon relief of the bending force, or (b) restriking the material in the same die at the same bend point to encourage the material to more closely conform to the desired die configuration. To facilitate over-compensation, tables of data resulting from incremental changes in springback with variances in the material thickness, hardness and bend radius have been generated. However, due to the numerous variables that seemingly affect mechanical press springback, such tables of data have been limited to simple bends, as in a V-shape.

Springback thus remains a problem in the pressing of mild steel into complex shapes. With the advent of high strength, low alloy steels having yield strengths in excess of 50,000 psi in relatively thin sections, it has been found that projecting and compensating for springback, based upon various physical characteristics of the material, does not work. It appears that the compound effect of higher material strength and typically higher mechanical press speeds, to form the material, cause considerably greater springback than that which is often encountered in producing parts made of conventional mild steel.

SUMMARY OF THE INVENTION

The invention relates to a method of deforming sheet material by use of a mechanical press having a counterpad to resist the action of the press ram and thereby to control the positioning of the sheet metal. The sheet material to be formed is bent sequentially by first and second increments of striking. The second increment of striking is carried out with a minimum positive pressure on the counterpad to resist the ram force; the latter effectively flattens or stretches the material during the second striking increment to shift the first bend loci away from the loci at which the second bending occurs. Residual springback from the first bending action subtracts from the springback of the second bending action to significantly reduce the resultant springback in the product. By control of die gap, residual springback can be optimized to equal or exceed springback from the second bending action and thus provide zero resultant springback, or, in some cases, a negative resultant springback.

The method comprises placing the sheet material to be formed between a male punch member and a female molding member and striking the members together to bend the sheet material about at least a first pair of bend loci. The female molding member has a movable counterpad disposed therein to controllably resist the force of said male punch member when brought thereagainst. The movable counterpad is preferably controlled to offer substantially zero counterpressure to the male punch member during the first striking increment. After withdrawing the male punch member from the female molding member, the members are restruck, while controlling the counterpad to offer a higher positive resistance force to the movement of the male punch member than that offered by the pad during the first striking action. The higher differential counterpressure of the pad forces the locus of the first bend to shift away from the locus at which the second bend occurs, thereby establishing separate and distinct bending radii so that the residual springback of the first bending action will function to subtract from the springback of the second bending action.

The above method can be carried out using at least two alternative modes. One mode consists of using two separate and independent striking actions to form the separate bends. The counterpad is preferably controlled to have substantially zero pressure during the first striking action permitting a crown to form in the material immediately beneath the male punch member; the counterpad is adjusted to have a positive pressure, typically greater than 50 psi, or a pressure sufficient to flatten the crown, during the second striking action.

Another mode includes carrying out both bending actions sequentially during a single striking operation; the counterpad is positioned so as to remain out of engagement with the sheet metal (thereby offering no resistance to the male punch member) during a predetermined increment of striking. After said predetermined increment of striking is completed, further increments of travel of the male punch member will confront the counterpad, which then offers a positive restraining force during the remainder of the ram travel.

In carrying out the method, it is advantageous and preferred that the bend angles, through which the sheet material is bent, be in the range of 45°-90°, and that the difference in pad pressure between the separate bending actions should be at least 40-50 psi, provided the pad pressure during the first bending is 30 psi or less (preferably zero). It is desirable that the die gap (the distance between the female molding member and the male punch member) be kept on the order of the material thickness, optimally at about the thickness plus 0.01 inch. The radius of the forming members for determining the bends should preferably be within the range of 0.1-0.3 inches, and advantageously no greater than 0.125 inch for the punch corner radius and no greater than 0.250 inch for the female molding member corner radius.

DETAILED DESCRIPTION

Figures 1, 2, 3:
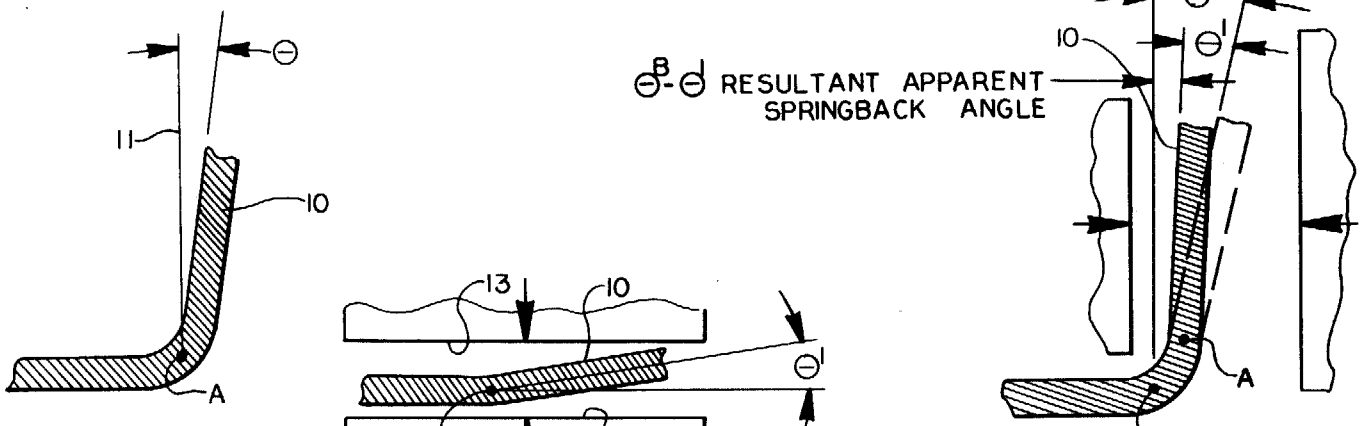
FIGS. 1–3 are diagramatic illustrations of the phases of the double bend phenomenon employed in the inventive method herein.

Springback is always present in a bending operation performed on sheet metal and cannot be theoretically eliminated since there is little one can do to alter the Young's modulus of a material. The types of sheet materials that respond to the method of this invention include metallic and nonmetallic materials having (a) an elongation of at least 1.5%, permitting the material to be permanently bent, and (b) a melting temperature at least double the temperature at which pressing occurs (so that the material can be cold worked in a solid rigid form at room temperature. When forming such materials with the use of a mechanical press, it has been found that the conventional mechanisms for compensating or allowing for springback are not reliable when working with higher speed presses and higher strength material such as HSLA material having a tensile strength greater than 50,000 psi.

A mechanical press is the machine used for most cold working opeations of sheet metal material. Such press consists of a machine frame supporting a bed and a ram, a source of power, and a mechanism to cause the ram to move in line with and at right angles to the bed. A press in and of itself is not sufficient as a production machine, but must be equipped with tools commonly called punch and molding members which together are designed for certain specific operations and forming contour. Typically, as used in the examples of this invention, a male punch member is carried by the ram and is moved in a downward direction to contact the upper surface of the sheet metal lying on a female molding member. The male punch member moves the sheet metal out of its normally flat plane against the contour of the female molding member requiring deep penetration of the male punch member into an opening of the female molding member, forming such complex sections as a U-shape or hat section.

Presses can be conveniently classified into two broad types, including hydraulic and mechanical presses. Mechanical presses are desirable, particularly in the automotive industry, because of the improved speed of cycling and thereby greater production. Mechanical presses that are associated with the method of this invention can have a variety of mechanical means for applying power to the ram such as through a crank, a cam, an eccentric, a power screw, a rack and pinion, a knuckle joint, a toggle, and even pneumatic means.

This invention has discovered that by deforming sheet metal with a press at two spaced bend loci (or bend radii), the resultant springback can be substantially, reduced and optimally eliminated. The prerequisite for this achievement is the existence of two bend corners which are spaced apart a small distance typically not easily observable (but in some instances observable). The relative sequential positions of the two corners is not a limitation. This invention achieves such result by way of a mechanical press using counterpad pressure. After a first bending action is completed at first bend loci, permitting a curved crown to exist therebetween, counterpressure is increased for the second bending action so that the curved crown is flattened and stretched to move the first bend loci apart. Thus, upon restriking or moving the punch through a new increment of travel, new bend loci are created which are spaced a slight distance inwardly from the first bend points.

Turning to FIG. 1, an illustration is given of why the resultant springback is reduced. The reduction of springback by this method can be explained on the basis that the elastic strain, introduced in each bending operation, is a predominent factor; one strain is offset against the other strain to control springback. In FIG. 1, after a bend is made at locus A, the free sidewall 10 of such bend is slanted from the desired upright plane 11 due to springback. Since the die used to form the bend was designed to form a right angle, the elastic nature of the material has withdrawn the free sidewall 10 back through an angle of theta ($\theta$). If, as shown in FIG. 2, the bend is compressed fully between two parallel blocks 12 and 13, the sheet metal will not go back to its original flat condition after release of the blocks; there remains a residual springback of theta prime ($\theta'$). This compression of the bend at A is what will take place if the deformed sheet metal of FIG. 1 were bent a second time, but at a bend locus of B (see FIG. 3). The previously free sidewall 10 will be pressed to a flat configuration when the bend B is formed; this is symbolized by dies 8 and 9 moving together. The inclination of the free wall 10 will have an apparent springback which is the composite of new springback $\theta^B$ (created by bending at B) counteracted by the residual springback $\theta^1$. This assumes the separation distance between the two bend loci A and B is not significantly great. Thus, the invention herein is a mechanism by which the original springback angle can be converted into a residual springback that works opposite to a subsequent springback increment $\theta^B$. This reduces the apparent or resultant springback significantly ($\theta^B - \theta^1$).

Figure 5:
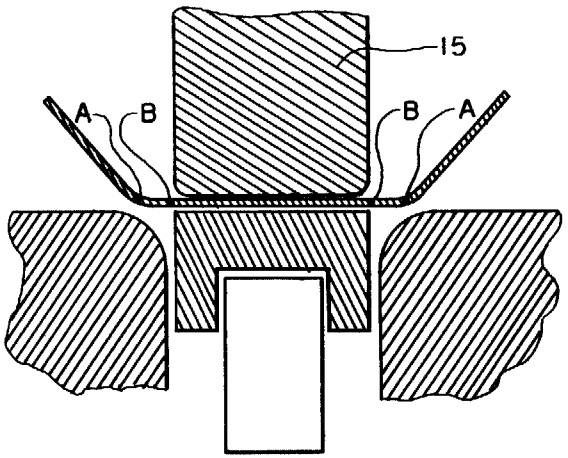
FIGS. 4–6 are diagramatic illustrations depicting the sequence of the method of this invention employing a mode wherein independent first and second striking actions are employed.
Figure 6:
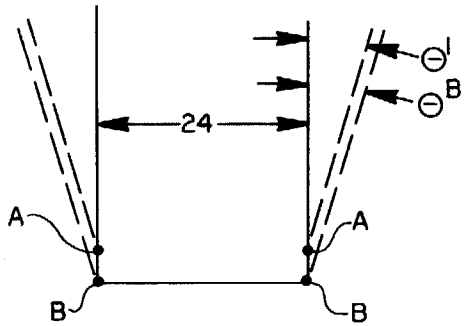
Figure 4:
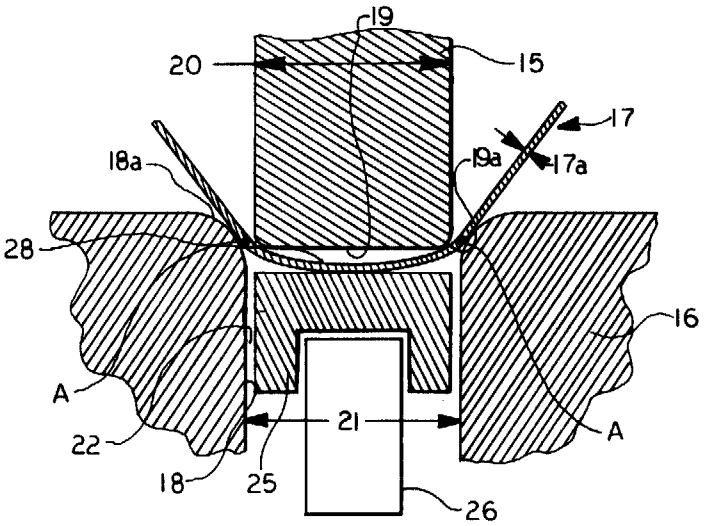

A preferred mode for carrying out the inventive method is illustrated in FIGS. 4–6. The first step of the method comprises striking together, through a first increment, a complimentary shaped male punch member 15 and a female molding member 16 with a flat sheet metal panel 17 therebetween. Increment is used herein to mean distance of movement of the male punch member relative to the female molding member that effects a desired bend in the sheet metal. The female molding member has an opening 18 with a mouth 18*a* provided with rounded edge A. The opening may be variously shaped such as a slot or other regular geometric configuration. The male punch member has a body with a substnatially flat bottom face 19 provided with rounded edges 19*a* at opposite sides. The transverse width 20 of face 19 is designed to be slightly smaller than the width 21 of opening 18, producing a die gap 22 after allowance is made for the thickness 17*a* of the sheet metal. The speed of striking is preferably in excess of 200"/min. and optimally 360"/min.

The striking action bends the sheet metal at least at a pair of bend loci identified as A. The male punch member is designed to form an overall U-shaped configuration in the sheet metal in cooperation with the female molding member. The preferred bending at locus A is 90°. The sidewalls 24 of the U are to be desirably parallel after deformation; however, springback from the first bending action causes the sidewalls to be canted outwardly an angle $\theta$.

During the first increment of the striking action, the counterpad 25 may be brought into contact with the sheet metal. The pressure of the counterpad is maintained at about zero to offer substantially no resistance to the male punch member as it proceeds through the first increment of travel in the female molding member. The counterpad is controlled as to resistive pressure by means 26 which may include hydraulic or mechanical apparatus.

The sheet metal form resulting from the first increment of striking action has a crown or curvilinear section 28 formed at the base of the U and between the first bend loci A. This curvilinear section is due to the presence of 4-point bending moment applied section 28. The sidewalls 24 possess a nonparallel condition because of uniform springback about locus A.

As shown in FIG. 5, the second step of the process is to strike the members 15 and 25 together through a second increment of travel with the first bent sheet metal therebetween (the sheet metal having bends at loci A). This step is preferably carried out by restriking the members 15 and 25, using the same punch member and female molding member as in step (a). During the second striking action, the counterpad is controlled to cooperate with said male punch member to flatten the curvilinear section so that the members bend the sheet metal at a pair of second bend loci B spaced differently than the first pair of bend loci A. This is preferably accomplished by controlling the counterpad to have a positive pressure resisting the male punch member and therefore flattening the crown portion of the preshaped sheet metal material against the face 19 of the male punch member. The preferred range of resistive pressure in 10–400 psi. This spreads the first bend loci further apart along the face 19, thereby causing the corners of the punch member 15 to engage the sheet metal at a new bend loci, identified as B. As the male punch member 15 is moved downwardly into the female molding member, a second bend action will take place. The second bending action forces the first bends to be flattened, leaving a residual bend angle of theta prime ($\theta'$). The residual bend angle or springback works in opposition to the new springback angle $\theta^B$ caused by bending at loci B. $\theta'$ thus must be subtracted from the new springback angle of theta to calculate the resultant springback angle. In the final configuration, as shown in FIG. 6, the sidewalls 24 of the U-shaped product will be substantially parallel and the resultant springback angle ($\theta^B - \theta^1$) will be substantially reduced and not apparent to ordinary inspection.

For purposes of this invention, striking is defined to mean the bending of sheet metal involving only very limited metal flow, usually restricted at the bend to one side of the sheet being subjected to tension, the other side, of course, being subjected to compression. This phenomena of bending is to be distinguished from drawing, where the entire cross-section of the sheet metal or member to be shaped is subjected to forces that exceed the elastic limit and thereby permit plastic flow of the metal throughout the entire cross-section.

Test results that confirm the usefulness of the described method are shown in FIGS. 7–10. Two types of sheet metal were subjected to U-channel bending operations in a mechanical press. One type was a conventional AKDQ sheet metal stamping metal having a nominal chemistry consisting of (by weight) 0.07% C, 0.23% Mn, <0.02% P, 0.018% S and 0.06% Al; and a high strength, low alloy sheet metal (HSLA) having a nominal composition consisting of (by weight) 0.09% C, 0.05% Mn, 0.011% P, 0.016% S, 0.08% Al and 0.23% Ti. Both metals were 0.031" thick (0.8 mm).

The male punch member 15 was shaped to have a width between corner radii of about one inch (25.4 mm), a length along its face of about five inches (127 mm), and a height along the line of movement of about three inches (76.2 mm). The corner radii of the male punch member was ⅛ inch (3.18 mm). The female molding member 16 had an opening 18 complimentary in shape to the male member allowing it to pass thereinto. The edge radii of the mouth entrance to opening 18 was about ¼ inch (6.35 mm). The members when struck together will form a U-shaped cross-section in the sheet metal member having 90° angles at its bend loci. The die gap could be set at any desirable width by varying backup shims supporting the split halves of the female molding member.

A single action mechanical press was used to carry the members. The press ram had an average calculated punch rate of 360"/min. (0.15 m/sec.). SAE 30 motor oil was coated on the sheet metal to function as a lubricant during pressing. Springback was measured; the overall experimental error due to variation of sheet metal properties was estimated to be about ±¼ degree.

Figure 7:
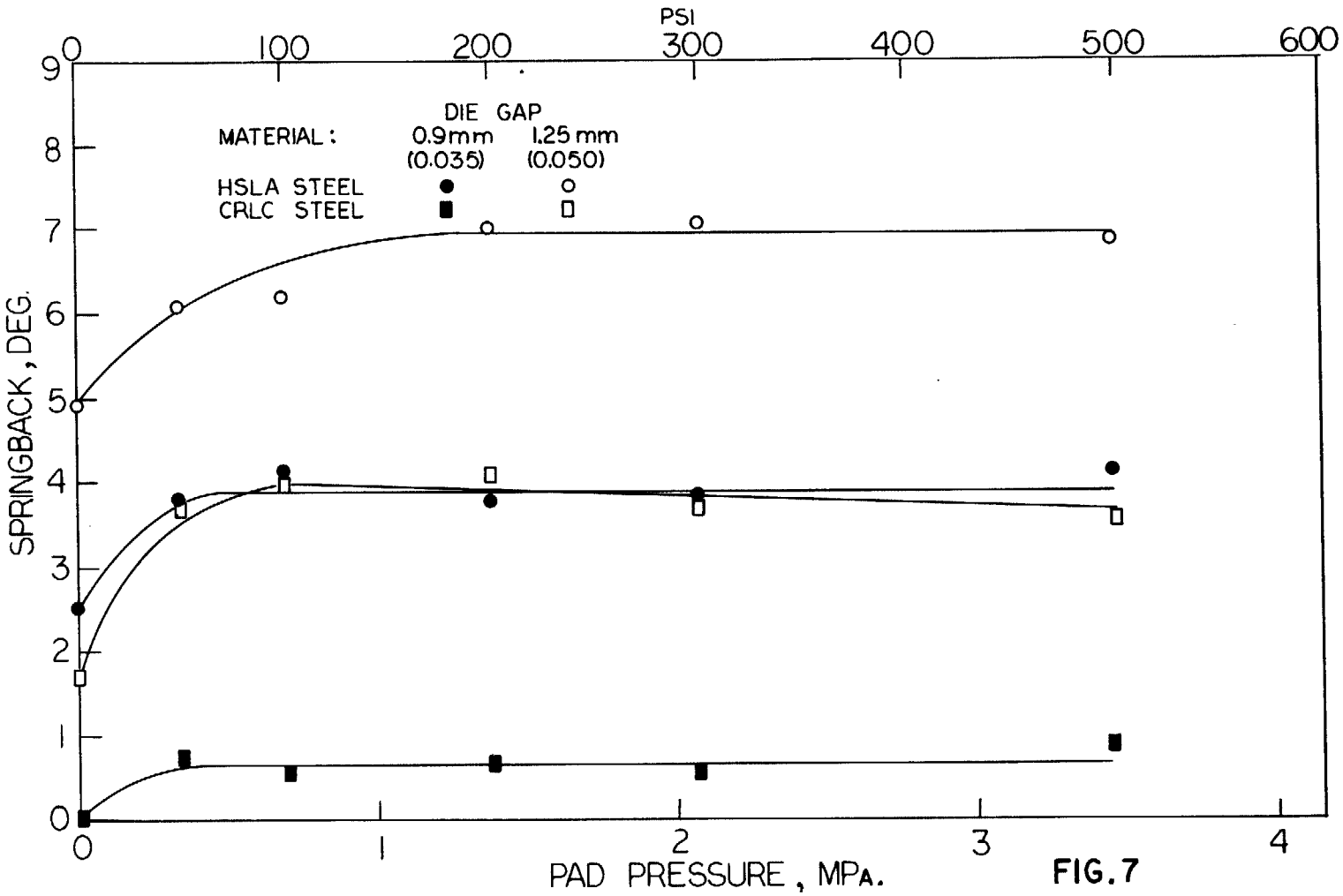
FIG. 7 is a diagram of the variance of springback with counterpad pressure; indicating also the effect of a change in die gap and steel composition as affecting the amount of springback, such data being generated by using a single striking action characteristic of the prior art.
Figure 8:
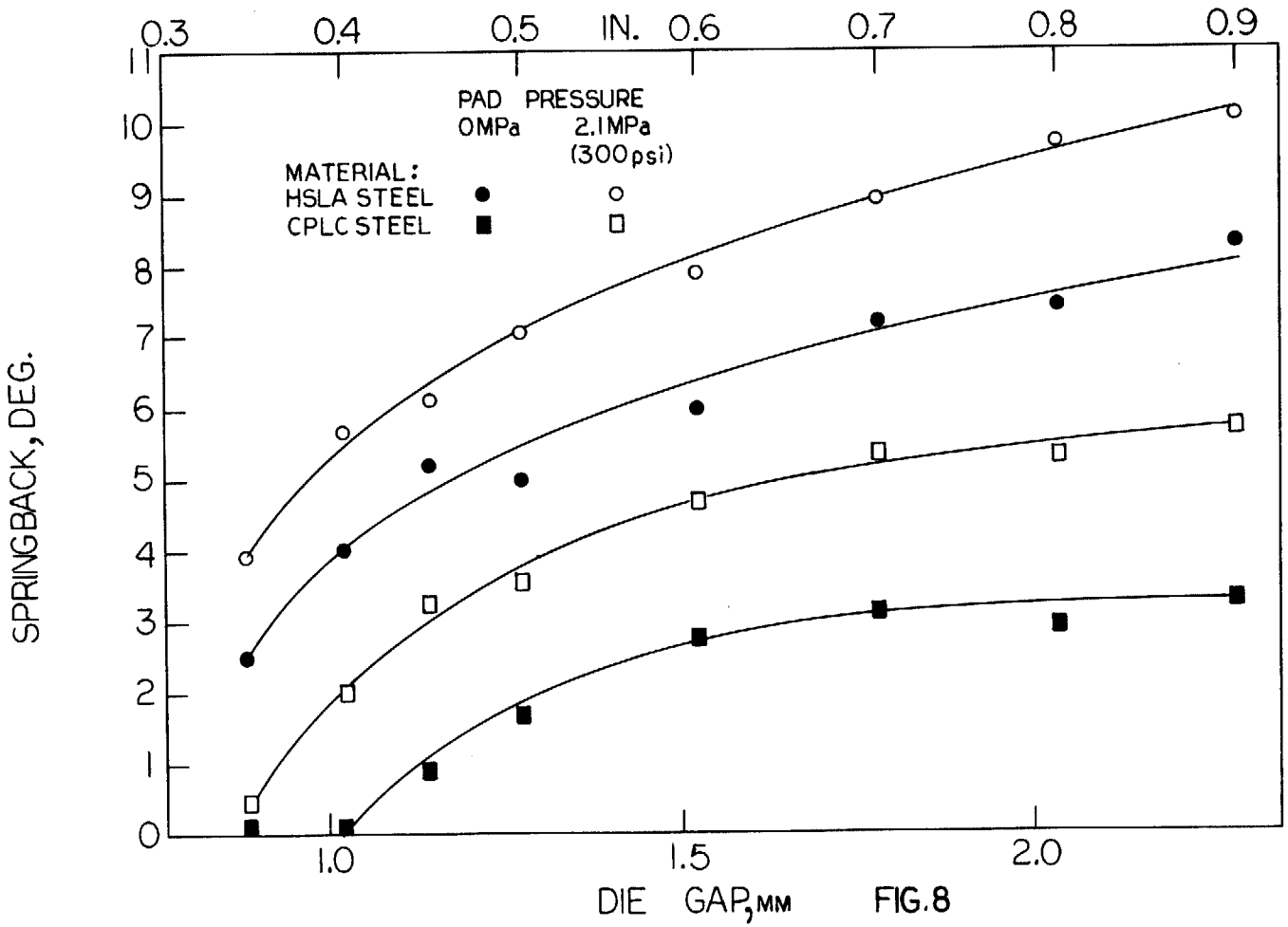
FIG. 8 is a diagram illustrating the variance of springback with die gap and for different counterpad pressures as well as different steel compositions, such data being generated by the single strike method characteristic of the prior art.

Sheet metal pressings were first made using only a single striking action. The die gap (defined to mean the distance between the sidewalls 29 of the male punch member and sidewall 27 of the female molding member, when mated) and the pressure applied to the counterpad 25 were varied in the hope of substantially reducing springback. However, as shown in FIG. 7, springback decreased with increasing counterpad pressure to a plateau. The plateau varied according to material and die gap. For the HSLA material, it was about 3° at 0.035" die gap and about 5° at 0.05" die gap. For the AKDQ material, it was about 1° at 0.035" die gap and about 2° (1.4 MPa) at 0.05" die gap. For HSLA and ADKQ steels, springback could not be eliminated by a variation in counterpad pressure. Also, as shown in FIG. 8, springback could not be eliminated by a variation in die gap for HSLA steels and substantially so for AKDQ steels.

Sheet metal pressings were then made using the method of this invention whereby differential counterpad pressures were used during two sequential striking increments. In this test, as in the preferred method, the members were restruck to provide the separate striking increments using the same size and settings for the members. The counterpad pressure was set at zero psi during the first striking action. This resulted in a crowned or bulged bottom of the sheet metal between the bend loci A. Without the restraint of the counterpad during the first striking action, the sheet metal is subjected to a 4-point bending moment which results in the curvilinear effect. Such curvilinear section can also be preformed intentionally with a desired crown by the forming shape of the members.

Also, variations of the method can be employed wherein the pressure of the counterpad is not absolutely zero during the first striking action, but is of an amount to permit the sheet metal to form some type of crown or bulge between the bend loci A. To permit this operation, the pad pressure may be in the range of 1-30 psi. The second counterpad pressure should preferably be at a minimum of about 40-50 psi above the initial pad pressure for the first strike action and sufficient to flatten the crown.

Figure 9:
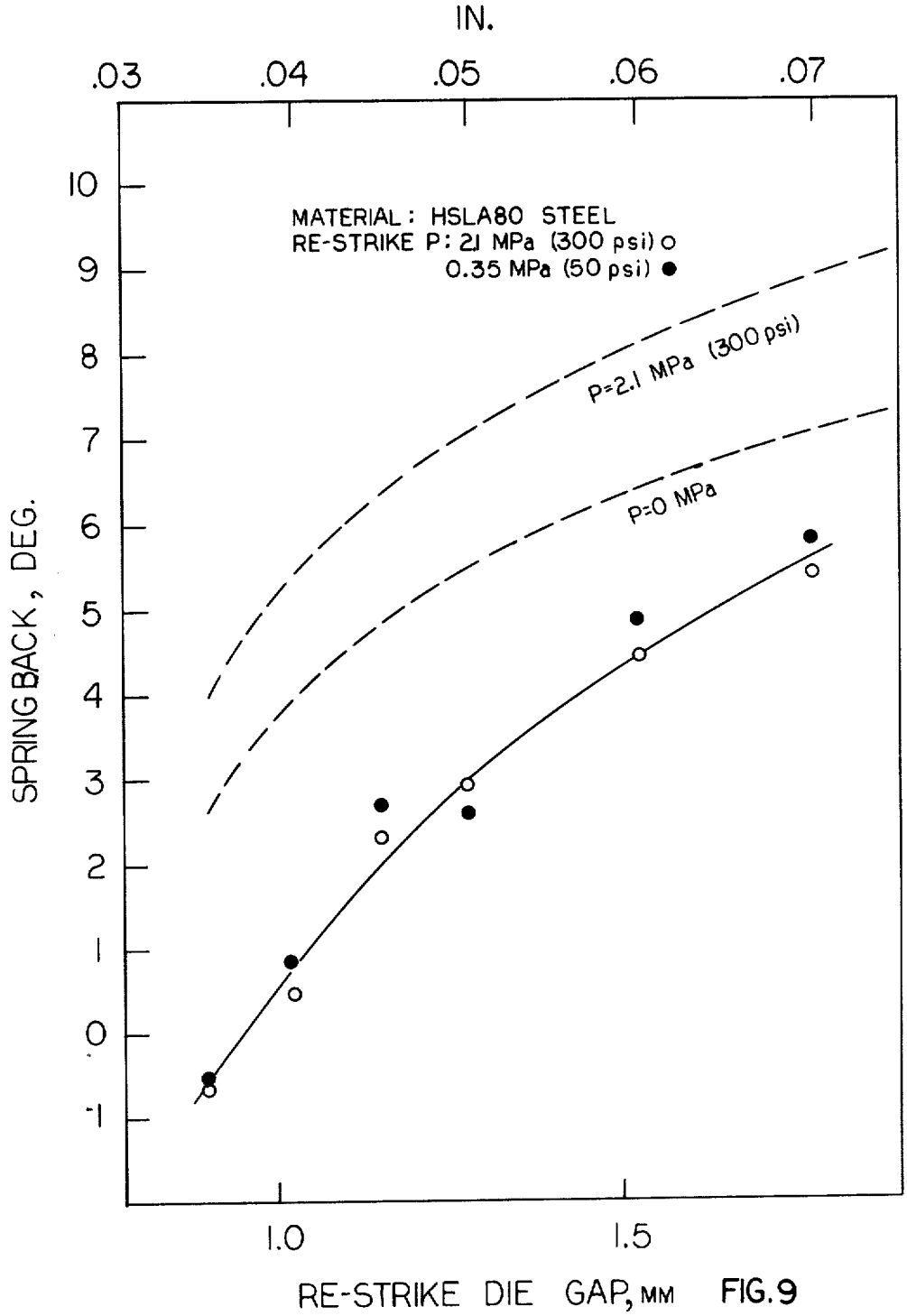
FIGS. 9 and 10 are diagrams illustrating the variance of springback with restrike die gap for different counterpad pressures using the method of this invention on both AKDQ and HSLA steel.

Upon restriking the sheet metal with the same members, but with a counterpad pressure of 300 psi, the curvilinear section was flattened instantaneously before the second bending action to cause the members to bend the metal at second bend loci B. As shown in FIG. 9, springback can be eliminated by this method for HSLA materials. Broken line plots 30 and 31 represent data for HSLA materials superimposed from FIG. 8 for the single strike method; full line plots 32 and 33 represents data for HSLA materials for the two strike method with differential pad pressure.

Also in FIG. 9, the effect of the two strike method with differential pad pressure is shown for AKDQ steels. Broken line plots 34 and 35 represent data taken from FIG. 7 for the single strike method; full line plot 36 is for the two strike method. The effect of positive pad pressure variation (between 50 and 300 psi) was undescernible within experimental scattering. Springback reduction was less responsive than for HSLA steels, but nonetheless observable.

The combination of controlling the differential counterpad pressure and the die gap can reduce springback to zero and even to a negative value. As shown in FIG. 9, for HSLA sheet metal with a thickness of 0.031", when the counterpad pressure was varied from zero to 300 psi, the springback was totally eliminated (reduced to zero) when the die gap was about 0.8 mm.

Figure 10:
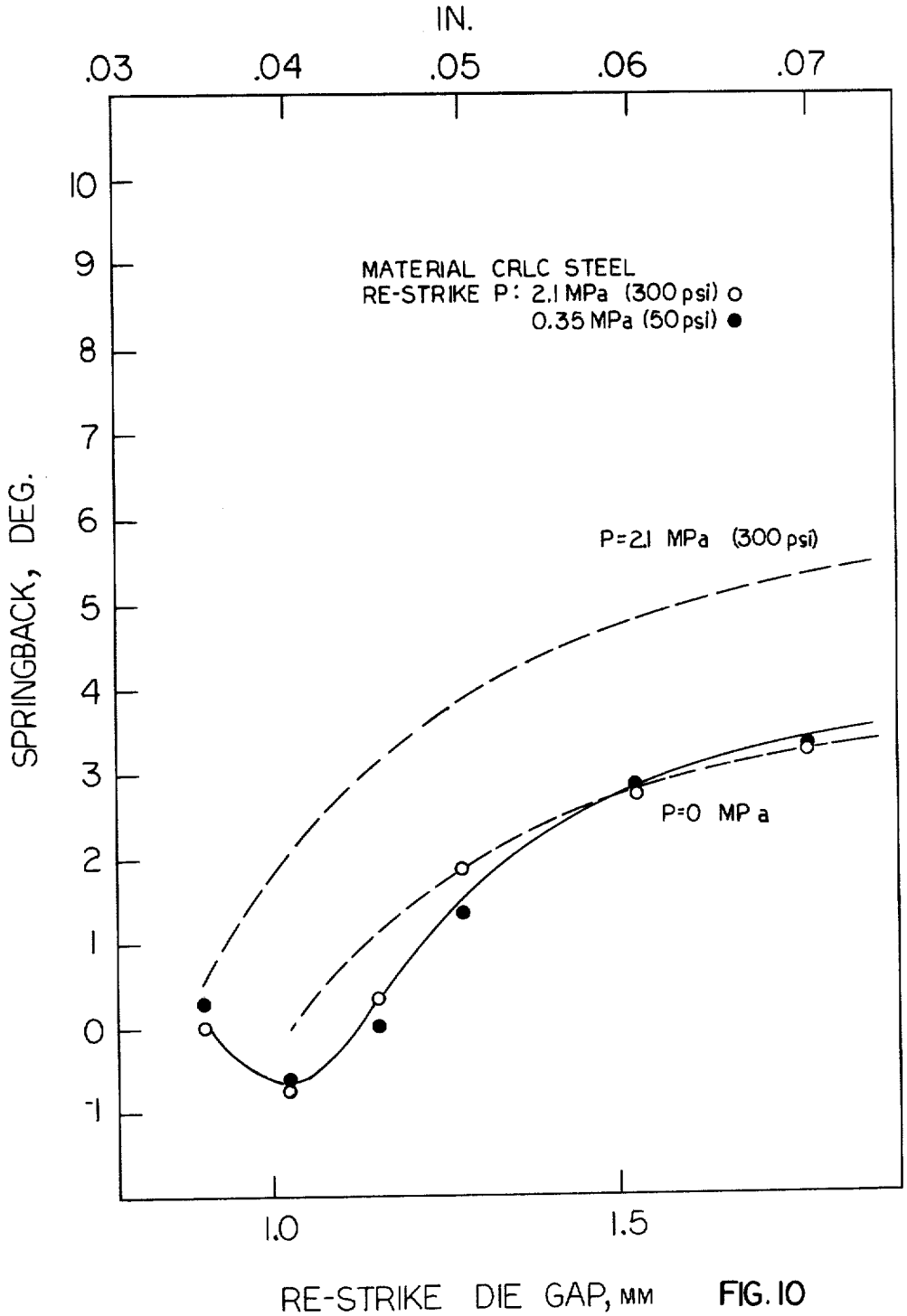

Turning now to FIG. 10, there is shown an alternative mode for carrying out the method of this invention which involves one continuous striking action, but with sequential striking increments of travel to achieve comparable results. The counterpad 25 is positioned at a predetermined distance h from the mouth 18*a* of the female molding member so that upon movement of the ram carrying the male punch member, the sheet metal will be struck and first bent while the punch travels through the distance h before counterpressure is confronted. The curvilinear section 28 is formed during the increment of travel of member 15 through distance h. The metal channel base is allowed to form freely because of the absence of counterpressure restraint permitting graded springback to take its effect. This first increment of travel can be considered equivalent to separately forming a channel shaped configuration with bend loci A.

Once the male punch member and sheet metal are brought into contact with the recessed counterpad, the curvilinear section of the sheet metal is flattened, spreading the first bend loci A to a wider spacing permitting the male punch member during the additional downward travel increment to engage the sheet metal at different bend loci B, causing second bends to be formed spaced a desired distance from the first bend loci A. The counterpad should be positioned below the female entrance 18*a* not less than 0.5", and preferably should not be in excess of one inch. Beyond one inch, the counterpad will have little influence on the springback reduction, and below 0.5", there is little opportunity to form the curvilinear section.

Figure 11:
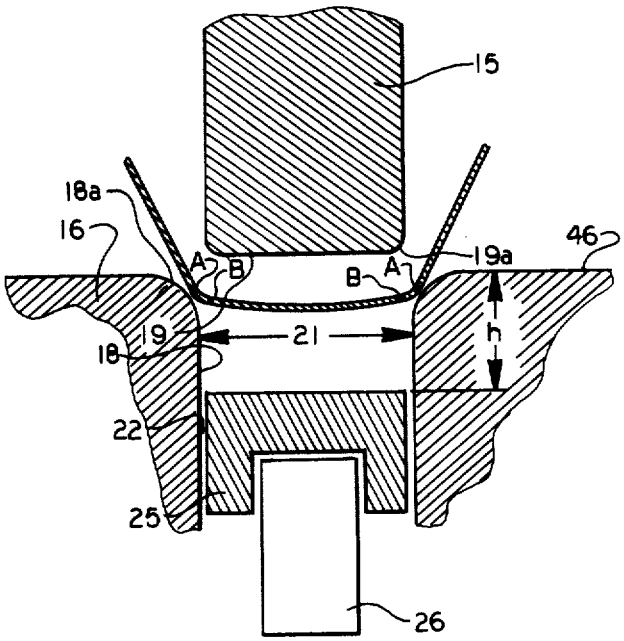
FIG. 11 is an illustration of an alternative mode for the present invention using only a single striking action permitting the first bending to take place during the first increment of travel and the second bending to take place during the last increment of travel.
Figure 12:
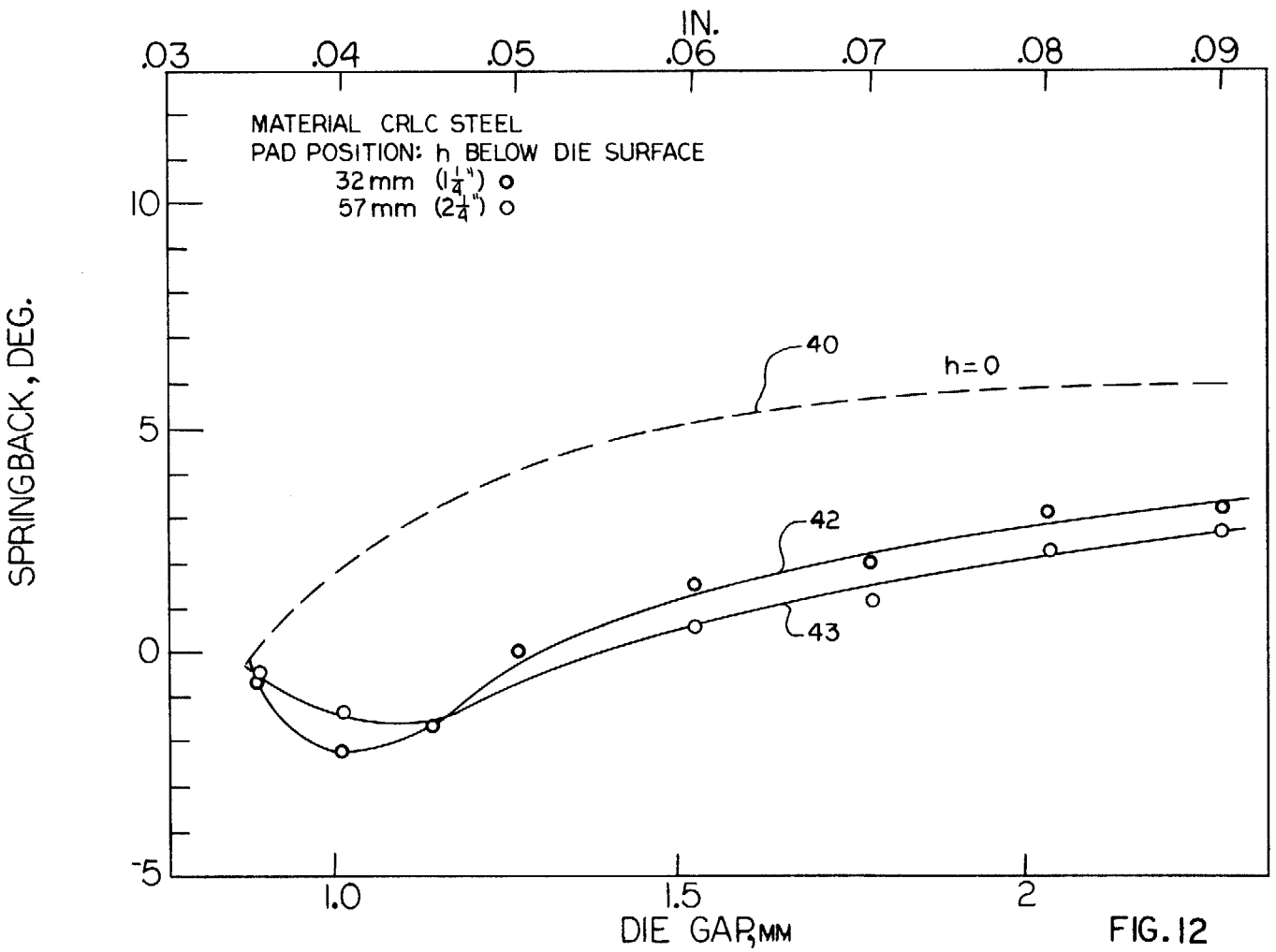
FIG. 12 is a diagram illustrating the variance of springback with die gap for AKDQ steel using the mode of FIG. 11 at different counterpad positions.
Figure 13:
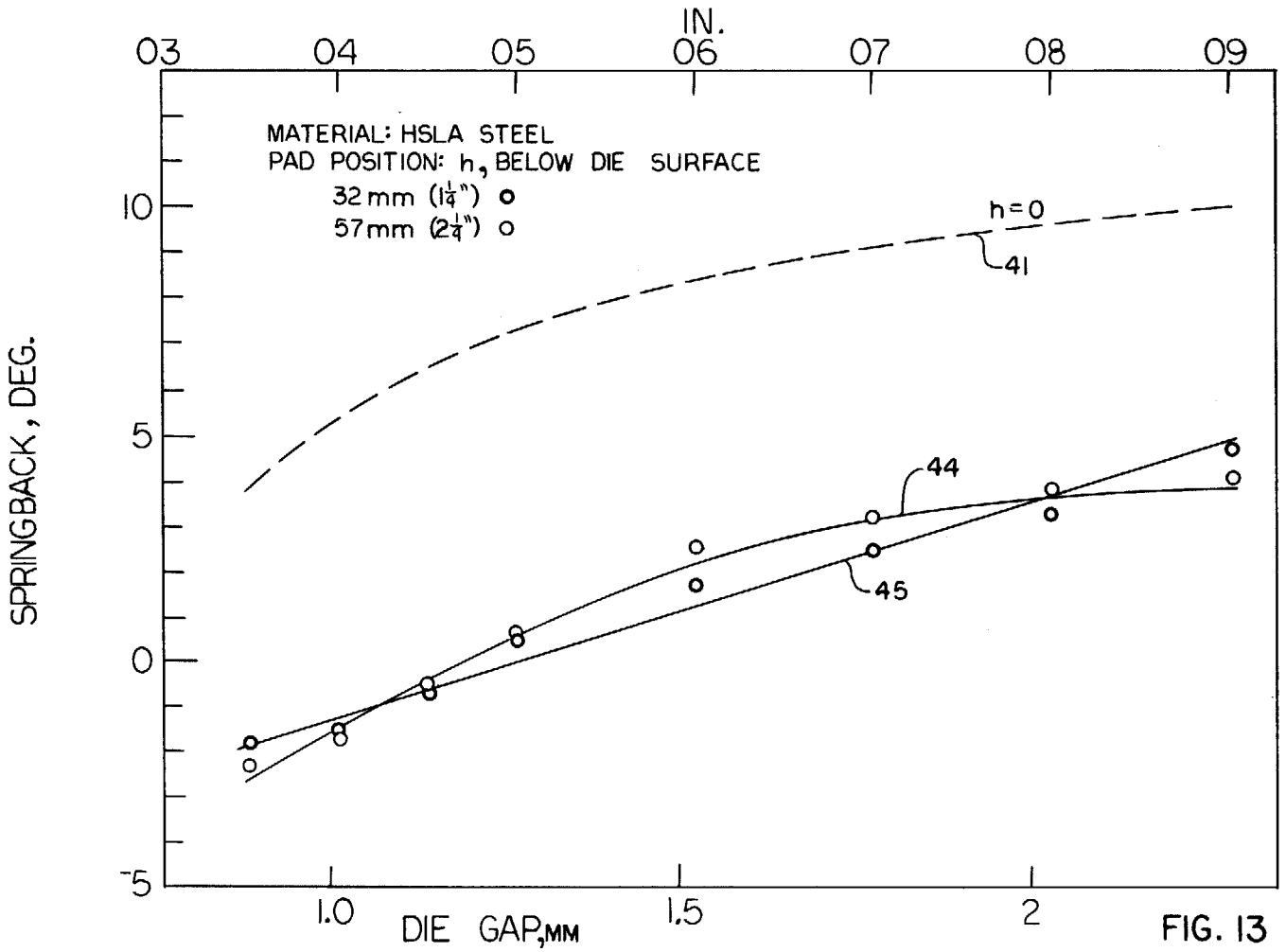
FIG. 13 is a diagram illustrating the variance of springback with die gap for HSLA steel using the method of FIG. 11 at different pad positions.

As shown in FIGS. 11 and 12, when the counterpad is positioned at h=0 (with a positive pressure of 300 psi), during a singular striking action, springback will be as shown by broken line plots 40 and 41 (data taken from FIGS. 7 and 8). However, when the counterpad is placed at various depths below the surface 46 of the female molding member (and applied with a resisting force of about 300 psi) and a various die gaps, springback is reduced and can be eliminated (see full line plots 42-43). For plots 42 and 43, the counterpad was positioned 1¼ inches below the surface 46 of the female molding member. When the counterpad is positioned 2¼ inches below the surface 46, substantially the same springback is experienced. The data in FIG. 11 is for AKDQ steel and in FIG. 12 for HSLA steel. For both materials, using a dropped counterpad position during a single striking action reduces springback at any given die gap. By optimizing die gap and depth h for any given steel sheet metal, springback can be toally eliminated. The resultant springback can also be designed a negative value; this can be obtained by regulating die gap and depth h to assure a value for $\theta'$ which exceeds $\theta^B$. Further optimization can be obtained by controlling the residual die gap (the gap between the punch and molding member minus the thickness of the material) to 0.003-0.01", preferably to about 0.004". This method is applicable to defining, in a unitary blank of sheet metal, sharp bend angles (such as 90° angles) between two straight metal portions, but is also applicable to providing rolled shapes, curled shapes and folded seams, all without excessive springback and thereby a more controlled configuration. Roll forming will work particularly well with this method, each described mode being applicable also to roll forming. The method may also be varied by designing the second bending action so that at least one of the second bend loci B is located between the first bend loci A.

I claim:

1. A method of bending sheet material by use of complimentary male punch and female molding members, said female molding member having a counterpad controllably movable to resist movement of the male punch member in said female molding member; the method comprising:

(a) striking said members together through a first increment with said sheet material therebetween to firstly bend said sheet metal at a first pair of bend loci spaced apart a predetermined distance, said counterpad permitting elastic strain to shape the sheet metal between said first bend loci as a curvilinear section;

(b) striking said members together through a second increment with said firstly bend sheet metal therebetween, said counterpad being controlled to cooperate with said male punch member to flatten said curvilinear section so that said members bend said sheet metal at a pair of second bend loci spaced differently than said first pair of bend loci.

2. The method as in claim 1, in which the striking action of each of said steps is carried out at a speed in excess of 200 inches per minute (0.10 m/sec.).

3. The method as in claim 1, in which said members force said sheet metal member through a bend angle of at least 45° at said bend loci when being struck.

4. The method as in claim 1, in which the said counterpad offers substantially no resistance to the male punch member during step (a) and provides a positive pressure in the range of 10–400 psi to resist the male punch member during step (b).

5. The method as in claim 1, in which the gap between the male punch member and the female molding member, after allowance for the thickness of the sheet metal therebetween, is at least 0.004 inches.

6. The method as in claim 1, in which said complimentary members are shaped to define a U-shaped channel, said U-shape having a crown portion formed between said first pair of bend radii as a result of said first striking, said crown portion being flattened during said second striking action to move bend radii of said first striking action apart.

7. The method as in claim 1, in which said sheet metal is comprised of high strength, low alloy steel having a tensile strength in excess of 50,000 psi and a thickness in the range of 0.04–0.06 inches, said first striking action being carried out with the use of a ram travel of about 360 inches per minute and the restrike being carried out with a die gap of about 0.035 inch.

8. The method as in claim 1, in which said sheet metal is selected from the group having a base consisting of alloy steel, carbon steel, aluminum, magnesium and copper.

9. The method as in claim 2, in which said second bend loci are spaced apart a distance greater than the distance separating said first bend loci.

10. The method as in claim 9, in which one of said second bend loci is between said pair of first bend loci.

11. A method of bending sheet metal by use of complimentary male punch and female molding members, said female molding member having a counterpad controllably movable to resist the movement of the male punch member in said female molding member; the method comprising:

(a) striking said members together with said sheet metal therebetween to firstly bend said sheet metal at a first pair of bend loci spaced apart a first distance, said counterpad being employed to allow the sheet metal between said pair of first loci to be subject to elastic strain and form a curvilinear section upon relief of said members; and (b) after withdrawing said male punch member from said female molding member, restriking said members with said first bent sheet metal therebetween, said counterpad being controlled to cooperate with said male punch member to flatten said curvilinear section and spread apart said first bend loci so that said members will bend said sheet metal at a pair of second bend loci.

12. A method of forming sheet metal by use of a mechanical press having complimentary shaped male punch member and female molding member, said female molding member having a counterpad for controllably and selectively resisting the movement of the male punch member; the method comprising:

(a) after stationing said counterpad a distance of at least 0.5–1.0 inches below the entrance to said female molding member, placing said sheet metal across the male punch member;

(b) striking said male punch member into said female molding member in a continuous motion whereby during a first increment of travel of said male punch member, before confronting said counterpad, the sheet metal is firstly bent at least at a pair of first bend loci separated by a curvilinear section of the sheet metal; and (c) continuing to strike said punch member into said female molding member through a second increment of travel while confronting said counterpad which resists with a positive force, said curvilinear section being flattened forcing said male punch member to bend said sheet metal at a pair of second bend loci while flattening the bends at said pair of first bend loci, thereby reducing the resultant apparent springback in the final product.

13. The method as in claim 12, in which the resisting force of said counterpad is in the range of 10–400 psi and in which the die gap between said female molding member and male punch member minus the thickness of the sheet metal is in the range of 0.005–0.015 inches.

* * * * *